US006409332B1

(12) United States Patent
Yraceburu et al.

(10) Patent No.: US 6,409,332 B1
(45) Date of Patent: Jun. 25, 2002

(54) LOW FLOW VACUUM PLATEN FOR INK-JET HARD COPY APPARATUS

(75) Inventors: Robert M Yraceburu, Circle Camas; Steve O Rasmussen, Vancouver; James O Beehler, Brush Prairie, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/514,830

(22) Filed: Feb. 28, 2000

(51) Int. Cl.[7] ..... B41J 2/01
(52) U.S. Cl. ..... 347/104; 271/197; 400/635
(58) Field of Search ..... 347/21, 104; 400/48, 400/635; 271/276, 197, 275; 346/134

(56) References Cited

U.S. PATENT DOCUMENTS 3,894,909 A * 7/1975 Rod ..... 156/568
4,237,466 A 12/1980 Scranton ..... 346/75
5,717,446 A * 2/1998 Teumer et al. ..... 347/35
5,782,183 A 7/1998 Andrews, Jr. ..... 101/232

FOREIGN PATENT DOCUMENTS

| | | |
|---|---|---|
| DE | 19829094 | 6/1998 |
| EP | 0095890 | 12/1983 |
| JP | 59097925 | 6/1984 |
| JP | 62196243 | 8/1987 |
| JP | 5127481 | 5/1993 |
| JP | 7025007 | 1/1995 |
| JP | 10175338 | 6/1998 |
| JP | 2000159342 | 6/2000 |

* cited by examiner

*Primary Examiner*—Craig A. Hallacher

(57) ABSTRACT

An ink-jet apparatus employs a platen having an array of vacuum ports that are each filtered. The filter is constructed to provide restricted-airflow rates which remain uniform when the platen is either fully covered or partially uncovered. The filter mechanism provides both airflow restrictions such that ink drop flight trajectories in the printing zone are unaffected, acoustic dampening of the vacuum pump is provided, and vacuum pressure is kept relatively high proximate the print media edges.

12 Claims, 2 Drawing Sheets

LOW FLOW VACUUM PLATEN FOR INK-JET HARD COPY APPARATUS

BACKGROUND OF THE INVENTION

1. Field of the Invention

The present invention relates generally to ink-jet hard copy apparatus and methods of operation and, more specifically to a low flow vacuum platen with minimal airflow induced drop directionality errors.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in OUTPUT HARDCOPY [sic] DEVICES, chapter 13 (Ed. R. C. Durbeck and S. Sherr, Academic Press, San Diego, 1988). As providing background information, the foregoing documents are incorporated herein by reference. Further details of basic ink-jet printing technology are also set forth below in the Detailed Description of the present invention with respect to FIG. 1.

It is known to use a vacuum induced force to adhere a sheet of flexible material to a surface, for example, for holding a sheet of print media temporarily to a transport system or platen. [Hereinafter, "vacuum induced force" is also referred to as "vacuum induced flow," "vacuum flow," or more simply as just "airflow," "vacuum" or "suction," as best fits the context.] Such vacuum holddown systems are a relatively common, economical technology to implement commercially and can improve hard copy apparatus throughput specifications. For example, it is known to provide a rotating drum with holes through the surface wherein a vacuum type airflow through the chamber formed by the drum cylinder provides a suction force at the holes in the drum surface (see e.g., U.S. Pat. No. 4,237,466 for a PAPER TRANSPORT SYSTEM FOR AN INK JET PRINTER (Scranton)). [The term "drum" as used hereinafter is intended to be synonymous with any curvilinear implementation incorporating the present invention; while the term "platen" can be defined as a flat holding surface, in hard copy technology it is also used for curvilinear surfaces, e.g., as the ubiquitous typewriter rubber roller; thus, for the purposes of the present application, "platen" is used generically for any shape paper holddown surface—stationary or movable—as used in a hard copy apparatus.] Permeable belts traversing a vacuum inducing support have been similarly employed (see e.g., Scranton and U.S. Pat. Appl. Ser. No. 09/163,098. by Rasmussen et al. for a BELT DRIVEN MEDIA HANDLING SYSTEM WITH FEEDBACK CONTROL FOR IMPROVING MEDIA ADVANCE ACCURACY (assigned to the common assignee of the present invention and incorporated herein by reference)).

Generally in a hard copy apparatus implementation, the vacuum device is used either to support cut-sheet print media during transport to and from a printing station of a hard copy apparatus, to hold the sheet media at the printing station while images or alphanumeric text are formed (also known as the "print zone" or "printing zone"), or both. [In order to further simplify description of the technology and invention, the term "paper" is used hereinafter to refer to all types of print media and the term "printer" to refer to all types of hard copy apparatus; no limitation on the scope of the invention is intended nor should any be implied.]

In essence, the ink-jet printing process involves digitized, dot-matrix manipulation of drops of ink, or other liquid colorant, ejected from a pen onto an adjacent paper. One or more ink-jet type writing instruments (also referred to in the art as an "ink-jet pen" or "print cartridge") include a printhead which generally consists of drop generator mechanisms and a number of columns of ink drop firing nozzles. Each column or selected subset of nozzles (referred to in the art as a "primitive") selectively fires ink droplets (typically each being only a few picoliters in liquid volume) that are used to create a predetermined print matrix of dots on the adjacently positioned paper as the pen is scanned across the media. A given nozzle of the printhead is used to address a given matrix column print position on the paper (referred to as a picture element, or "pixel."). Horizontal positions, matrix pixel rows, on the paper are addressed by repeatedly firing a given nozzle at matrix row print positions as the pen is scanned. Thus, a single sweep scan of the pen across the paper can print a swath of dots. The paper is stepped to permit a series of contiguous swaths. Dot matrix manipulation is used to form alphanumeric characters, graphical images, and even photographic reproductions from the ink drops. Page-wide ink-jet printheads are also contemplated and are adaptable to the present invention.

As the ink-jet writing instruments—often scanning at a relatively high rate, across the paper—expel minute droplets of ink onto adjacently positioned print media and sophisticated, computerized, dot matrix manipulation is used to render text and form graphic images, the flight trajectory of each drop is critical to print quality. Printing errors (also referred to in the art as "artifacts") are induced or exacerbated by any airflow in the printing zone. Thus, use of a vacuum platen and vacuum transport device in the printing zone of an ink-jet printer creates an added difficulty for the system designer.

There is a need for a vacuum system for use in an ink-jet printing zone which will provide a minimal airflow impact on ink-jet drop flight trajectory.

SUMMARY OF THE INVENTION

In its basic aspects, the present invention provides a print media vacuum platen system including: a vacuum box, having at least one surface thereof further comprising filter mechanisms for permitting airflow therethrough; associated with the vacuum box, vacuum mechanisms for creating a negative pressure within the vacuum box and inducing the airflow through the filter mechanisms; and mounted adjacently to the filter mechanisms distally from the vacuum box, platen mechanisms for holding print media in a position for ink-jet printing thereon, the platen mechanisms having a plurality of vacuum passages therethrough such that regions of the filter mechanisms form a porous floor for each of the passages.

In another basic aspect, the present invention provides a method for providing a substantially uniform airflow across an ink-jet print media vacuum platen associated with a vacuum inducing mechanism. The method includes the steps of: drawing a vacuum through a plurality of vacuum ports distributed across the platen; and filtering the airflow through the ports via an airflow restrictive porous material filter interposed between the platen and the vacuum inducing mechanism.

In another basic aspect, the present invention provides an ink-jet hard copy apparatus including: an ink-jet writing instrument associated with a printing zone within the apparatus; an endless loop vacuum belt system for transporting print media to and from the printing zone; a vacuum platen system located proximate the printing zone, the vacuum platen system having a platen, having a plurality of vacuum ports therethrough, a vacuum chamber, having one wall thereof fabricated of a porous material, the one wall being adjacent the platen such that the material forms a flooring for each of the ports, a vacuum device for maintaining a negative pressure within the chamber such that an airflow is established through the vacuum ports into the chamber via the porous material such that a substantially uniform vacuum force is exerted across the media regardless of the number of vacuum ports covered or partially covered by the print media.

Some of the advantages of the present invention are:

- it provides a low flow vacuum system with minimal airflow induced ink drop directionality errors;
- it provides a substantially uniform vacuum field regardless of degree of platen coverage;
- it provides a low flow platen that allows vacuum box pressure to remain relatively constant whether or not paper is fully covering the platen, thus compensating for different sized print media;
- it allows for various media sizes and thicknesses to be held down with substantially the same pressure without requiring a large vacuum source;
- it reduces acoustic levels caused by a vacuum induced airflow;
- it provides a platen that is resistant to clogging by ink and paper dust; and
- it provides improved vacuum holding at paper edges.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
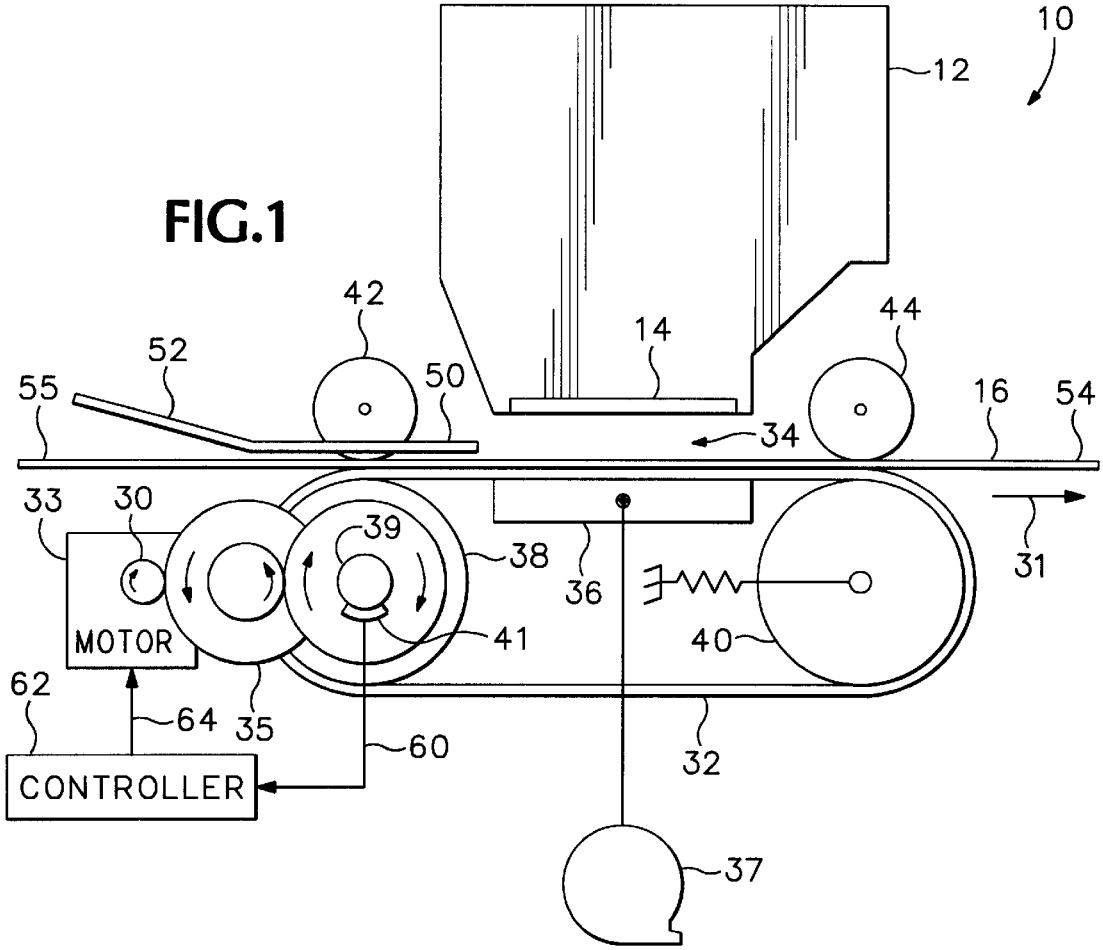
FIG. 1 is a schematic illustration of an ink-jet hard copy apparatus in accordance with the present invention.

FIG. 1 is a schematic depiction of an exemplary embodiment of an ink-jet hard copy apparatus 10 in accordance with the present invention. A writing instrument 12 is provided with a printhead 14, having drop generators including nozzles for ejecting ink droplets onto an adjacently positioned print medium, e.g., a sheet of paper 16, in the apparatus' printing zone 34.

One type printing zone input-output paper transport, and a preferred embodiment for the present invention, is an endless-loop belt 32 subsystem. A motor 33 having a drive shaft 30 is used to drive a gear train 35 coupled to a belt pulley 38 mounted on an fixed axle 39. A biased idler wheel 40 provides appropriate tensioning of the belt 32. The belt rides over a generic platen 36 in the print zone 34; a specific platen subsystem in accordance with the present invention is described in detail hereinafter with respect to FIGS. 3 and 3A, but in general the vacuum platen subsystem is associated with a known manner vacuum induction system 37 (for simplicity of description referred to hereinafter as merely a "pump;" actual induced vacuum force is a function of specific implementation design factors, such as sizes, shapes, thicknesses of the media, and the like as would be known to a person skilled in the art). The paper sheet 16 is picked from an input supply (not shown) and its leading edge 54 is delivered to a guide 50, 52 aligned for delivering a leading edge to the belt; an optional pinch wheel 42 in contact with the belt 32 may be used to assist transport of the paper sheet 16 through the printing zone 34 (the paper path is represented by arrow 31). While vacuum release downstream of the printing zone 34 may be sufficient to transport the sheet 16 toward the output, an output roller 44 in contact with the belt 32 may optionally be used to receive the leading edge 54 of the paper sheet 16 and continue the paper transport until the trailing edge 55 of the now printed page is released. Belt porosity and vacuum force requirements will be a function of a specific printer 10 design.

Figure 2:
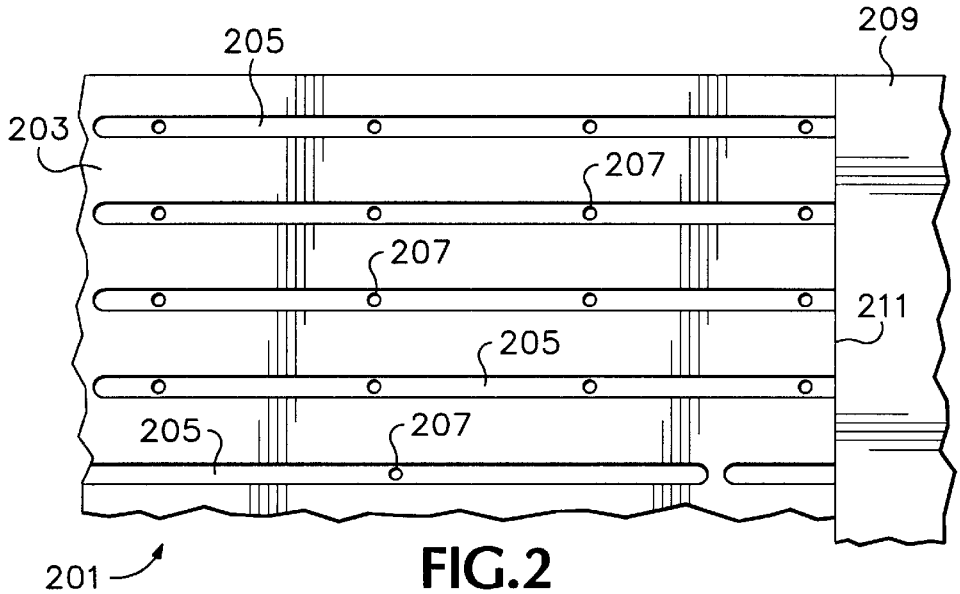
FIG.2 (PRIOR ART)
FIG. 2 (Prior Art) is a planar, overhead view of detail of the top surface of a vacuum platen.

Referring to both FIGS. 1 and FIG. 2 (Prior Art), a specific type of platen 201 is illustrated. This platen 201 has a top surface 203 over which the belt 32 slides. Slots 205 in the surface 203 are coupled to the subjacent vacuum induction system 37 by through-holes 207 to distribute the vacuum force across the platen 201 to hold the sheet of paper 16. A region 209 of the sheet of paper 16 is shown covering part of the surface 203 area. When a slot 205 is fully or partially open, as shown, airflow is high through the holes 207 of that slot 205 since the region 209 of paper is not closing the entire slot off from the local atmosphere. This can cause several problems. For example, the airflow into the vacuum box is high for smaller media that leaves a large percentage of the platen surface 203 open. This requires a relatively large vacuum pump 37. If the surface 203 is mostly open (e.g., when a 3×5-inch card is on a 12×16-inch platen such that there is only about eight percent platen coverage), the pump 37 must provide a very large flow (e.g., 200 CFM or greater) before the appropriate vacuum level (e.g., at least 6-inches $H_2O$) is produced in the slots 205 beneath the card. A large vacuum pump is undesirable since it leads to noise problems and increased cost of manufacture. The use of smaller holes 207 weakens vacuum levels in partially open slots 205 and leads to still other problems as smaller holes tend to clog with ink and paper dust. As another example, high airflow is induced around the edge 211 of the paper 209 which disturbs ink droplet flight trajectory from the pen 12 (FIG. 1 only) to the paper 209. Moreover, the vacuum force exerted on the underside of the paper 209 is diminished in partially open slots which might permit undesirable paper flexing or motion during a printing cycle.

Figure 3:
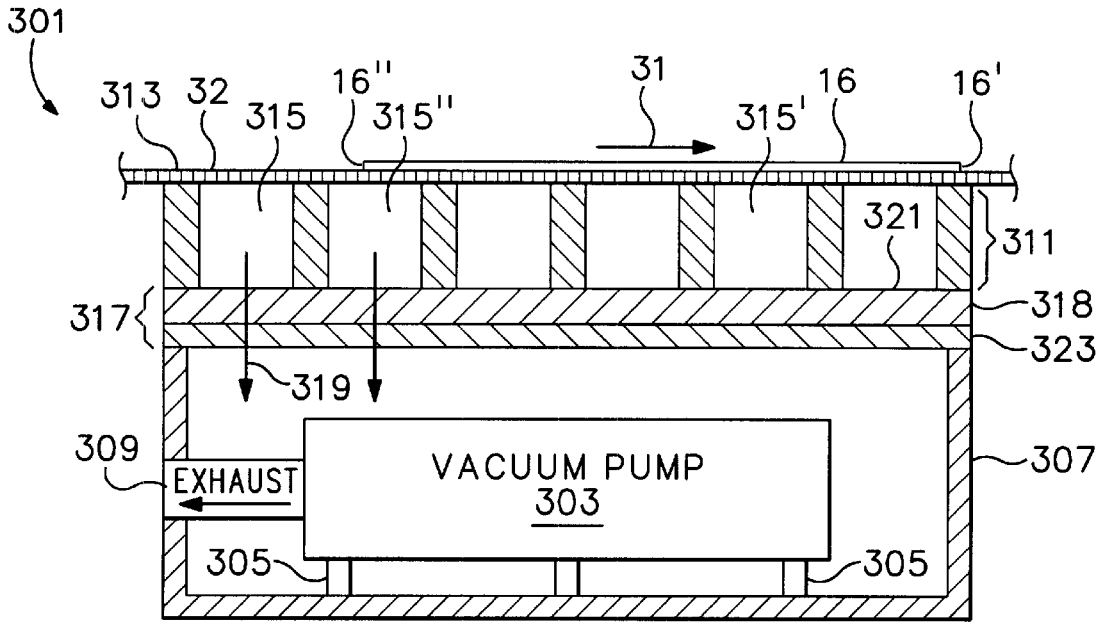
FIG. 3 is a schematic depiction of a vacuum platen system used in the present invention as also shown in FIG. 1.

Referring now to both FIGS. 1 and 3, illustrations of the details of the vacuum platen system 301 for the hard copy apparatus 10 are shown. The system 301 fundamentally substitutes in the printing zone 34 of FIG. 1 for elements 36 and 37. Electrical power is supplied in any known manner; further details are not required for an understanding of the present invention.

A vacuum creating device, such as a pump or exhaust mechanism, 303 is mounted 305 in any known manner in a vacuum box 307. Appropriate exhaust (represented by the labeled arrow) manifolding 309 is provided. A sheet of paper 16 is transported along paper path 31 to the printing zone 34 by the perforated transport belt 32. A platen 311 member is mounted atop the vacuum box 307. While in the shown embodiment it has been found that incorporating the pump 303 into the vacuum box provides a commercially viable arrangement, it will be apparent to those skilled in the art that the vacuum pump can be remotely located in the printer 10 and coupled to the vacuum box 307.

Figure 3A:
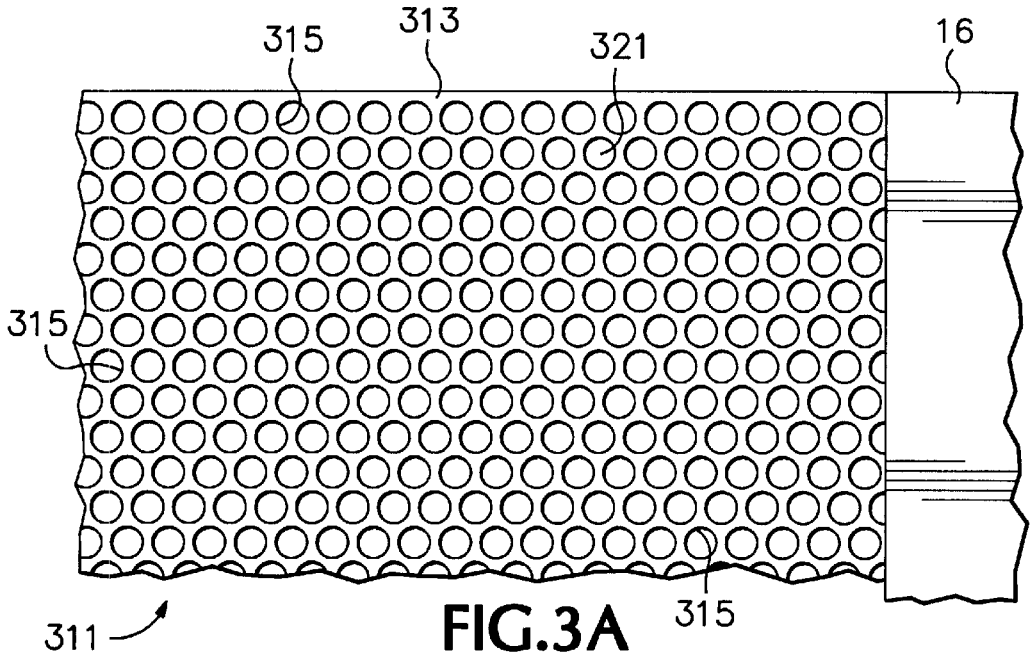
FIG. 3A is a schematic depiction in a planar, overhead view of detail of the top surface of a vacuum platen in accordance with the present invention as shown in FIG. 3.

Turning also to FIG. 3A (to best illustrate features of the present invention, the belt 32 is not shown), the platen 311 surface 313 has an array of vacuum passageways, or ports, 315 distributed across the surface. The distribution pattern can vary depending on the design specifics of a particular implementation. In the exemplary embodiment shown, the pattern is a staggered row and column linear array of substantially circular apertures. The platen 311 can be nearly all open as shown, or mostly solid material depending on the needed vacuum holddown area and force design requirements. Optimally, the paper sheet 16 fully closes subjacent ports 315, but at edges 16', 16", may only partially close subjacent ports, such as trailing edge 16" in FIG. 3 partially covering port 315".

It is preferable that the vacuum ports 315 be large enough so that they do not clog with ink or paper dust. Ports 315 having a diameter in the approximate range of two to seven (2–7) millimeters have been found to be suitable to ink-jet printing conditions.

Returning to FIG. 3, the vacuum box 307 has a lid 317 that is essentially an airflow filter. The lid-filter 317 is mounted to segregate and fluidically couple the vacuum box 307 and platen 311. Airflow induced by the vacuum pump 303 through the platen ports 315 and lid-filter 317 is represented by arrows 319. There are platen side areas of the filter material 321 that act as a floor of each vacuum port 315 and a relatively large volume of filter material on the vacuum side of the platen 311 to trap such debris without clogging the system. The lid-filter 317 provides flow restriction to enable uniform suction, that is, even vacuum pressure distribution, to the underside the media on the platen 201. Moreover, no substantial ink mist and paper dust reaches the vacuum pump where it would eventually affect pump 303 operations. Note that with the pattern described, there is an advantage of having fully covered ports closer to the edges of the media.

In other words, the ports 315 are large enough not to clog but filtered such that due to the flow restriction effect of the filter material, if one is partially open there will be relatively little airflow through the open portion which could alter ink drop flight trajectories near the paper edges or lead to excessive loss of vacuum pressure at the edges. This is particularly important for high quality graphics and photographic type printing where the user may wish to print the entire page with extremely small margins (also known in the art as "full bleed" printing).

This system allows use of a relatively small vacuum pump to maintain a substantially constant vacuum box 307 negative pressure.

It has been found that for a preferred embodiment, the lid-filter 317 element itself is layered, or graduated, from being relatively porous (coarse material 318) proximate the underside of the platen 311 to relatively dense (fine material 323) superjacent to the vacuum box 307. Air flow through the coarse material region 321 at the floor of each port 315 is freer, removing ink mist, paper dust, and other known ink-jet process contaminants through the ports 315, particularly via open ports or partially open ports 315". The fine material 323 acts to restrict airflow to desired levels.

While use of any filter material that provides an adequate filtering and pressure drop may be employed in implementing the present invention, preferred material for the lid-filter 317 is selected from the group comprising polypropylene, cotton, polyester, PTFE, cellulose or the like paper, or sintered materials such as of plastic or metals. Commercially available G300 and SBMF materials from 3M Corp., St. Paul, Minn., have been successfully employed in accordance with the present invention. Generally, it is believed that materials from 5 $gm/m^2$ to 500 $gm/m^2$ may be employed, depending on the requirements of a specific implementation. It has been found that the use of these materials versus use of a more solid screen type material for a lid-filter 317 provides superior acoustic dampening. An approximate range of 0.1 $CFM/in.^2$ to 1.5 $CFM/in.^2$, about three to fifty inches $H_2O$ can be employed; specific implementations can vary.

It will be recognized by those skilled in the art that while the present invention has been illustrated in a substantially planar embodiment, the concept is applicable to curvilinear platen implementation, including vacuum drum designs where the platen, filter (or filters), and vacuum box are concentric constructs.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for. . . . "

What is claimed is:

1. A print media vacuum platen system comprising:

a vacuum box, having at least one surface thereof further comprising a filter means for permitting airflow therethrough and having a porous material associated with ink-jet contaminant sizes and predetermined vacuum pressure drop levels;

associated with the vacuum box, vacuum means for creating a negative pressure within the vacuum box and inducing the airflow through the filter means; and mounted adjacently to the filter means and distally from the vacuum box, platen means for holding print media in a position for ink-jet printing thereon, the platen means having a plurality of vacuum passages therethrough such that regions of the filter means form a porous floor for each of the passages.

2. The system as set forth in claim 1, the porous material further comprising:

material selected from a group including polypropylene, cotton, polyester, PTFE, cellulose, paper, or sintered materials of plastic or metals.

3. The system as set forth in claim 1, the porous material further comprising:

a material having a varying porosity wherein coarsest material has a surface area subjacent the platen means.

4. The system as set forth in claim 1, the porous material further comprising:

a material having a varying porosity wherein the finest material is proximate the vacuum means and acts to restrict airflow through the filter means to a predetermined level.

5. The system as set forth in claim 1, the porous material further comprising:

an acoustic dampening material.

6. The system as set forth in claim 1, comprising:

each of the vacuum passages have an average cross-dimension in a range of approximately two to seven millimeters.

7. The system as set forth in claim 1, comprising:

the vacuum passages are arranged in a staggered row and column linear array of substantially circular apertures.

8. The system as set forth in claim 7, comprising:

the array forms a pattern such that the platen surface is substantially all open or substantially solid material as a function of vacuum holddown area and force requirements.

9. The system as set forth in claim 1, comprising:

each of the vacuum passages are of a size and dimension large enough such that the passages do not clog with ink or paper dust and small enough that if one is partially open relatively low airflow is pulled through the open portion such that the airflow does not alter ink drop flight trajectories proximate thereto.

10. The system as set forth in claim 1, comprising:

each of the vacuum passages are of a size and dimension large enough such that the passages do not clog with ink or paper dust and small enough that if one or more passages are partially open relatively low airflow is pulled through the open portion such that there is substantially no loss of vacuum pressure on print media adjacent the one or more passages.

11. The system as set forth in claim 1, comprising:

each of the vacuum passages has a surface area of filter material acting as a floor layer between the platen and the vacuum box.

12. The system as set forth in claim 1, comprising:

the system is a curvilinear construct such that platen means, filter means, and vacuum box are substantially concentric constructs.

* * * * *